US007503803B2

(12) United States Patent
Lappoehn

(10) Patent No.: US 7,503,803 B2
(45) Date of Patent: Mar. 17, 2009

(54) PLUG-IN CONNECTOR HAVING AT LEAST ONE SIDE ELEMENT

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/903,305

(22) Filed: Sep. 21, 2007

(65) Prior Publication Data

US 2008/0090463 A1 Apr. 17, 2008

(30) Foreign Application Priority Data

Oct. 13, 2006 (DE) ..... 10 2006 049 070

(51) Int. Cl.
*H01R 13/648* (2006.01)

(52) U.S. Cl. ..... 439/607; 439/95; 439/571

(58) Field of Classification Search ..... 439/79, 439/95, 566, 570, 571, 607, 752
See application file for complete search history.

(56) References Cited

U.S. PATENT DOCUMENTS 5,201,625 A * 4/1993 Takenouchi et al. ..... 411/369
5,228,867 A * 7/1993 Nagamine ..... 439/364
5,228,873 A 7/1993 Hirai
5,273,460 A * 12/1993 Arai ..... 439/609
5,486,122 A * 1/1996 Oda et al. ..... 439/752
5,603,639 A * 2/1997 Lai et al. ..... 439/607
6,012,954 A 1/2000 Wu
6,050,852 A * 4/2000 Wu ..... 439/607
6,210,220 B1 * 4/2001 Zhu et al. ..... 439/567
6,780,068 B2 * 8/2004 Bartholoma et al. ..... 439/752
7,048,581 B1 * 5/2006 Wong ..... 439/595
2005/0003713 A1 1/2005 Lappoehn

FOREIGN PATENT DOCUMENTS

DE 93 18 026 U1 3/1994
DE 103 29 894 B3 5/2005

* cited by examiner

*Primary Examiner*—Thanh-Tam T Le
(74) *Attorney, Agent, or Firm*—Collard & Roe, P.C.

(57) ABSTRACT

The invention relates to a plug-in connector (10) having a base element (11) and at least one side element (12). There is further provided that at least one mounting element (13) for mounting the plug-in connector (10) and/or for mounting a matching plug-in connector. The side element 12) comprises at least one locating element (20) which fixes the mounting element (13) in its position in the mounted condition of the plug-in connector (10). Preferably, a screening element (14) is further provided which is likewise fixed in its position by the mounting element (13).

The plug-in connector (10) according to the invention provides a high pull-out force relative to an element that is mechanically connected with the mounting element (13) either directly or indirectly. Further, a high electric screening function can be achieved with the plug-in connector (10) according to the invention.

13 Claims, 4 Drawing Sheets

PLUG-IN CONNECTOR HAVING AT LEAST ONE SIDE ELEMENT

PRIOR ART

The present invention relates to a plug-in connector having at least one side element according to the preamble of the independent claim.

Standardized plug-in connectors intended for connecting computers to peripheral units, which may be described as trapezoid plug-in connector, C-Sub plug-in connectors or as TMC plug-in connectors, have been known especially in computer technology.

A plug-in connector of that kind has been proposed, for example, by DE Utility Patent 93 18 026 and comprises a screening element located on the forward end of the plug-in connector and enclosing the contact elements of the plug-in connector at least in the forward region. The screening element is produced by deep-drawing from a thin sheet material. The narrow sides of the screening element are provided with flanges in which mounting openings are arranged. The screening element is electrically connected, in the area of the mounting openings, to a contact element of the plug-in connector which serves to connect the screening element to an electric circuit mass.

DE Patent 103 29 894 discloses a plug-in connector of the species described herein having a base element and at least one side element. The side element is implemented as mounting means by means of which the base element can be fixed on a circuit board. For mounting the plug-in connector on an additional component, such as a matching plug-in connector or a housing, a detent element is provided on the side element that passes through a corresponding recess in the screening element provided on the front of the base element.

It is the object of the present invention to provide a plug-in connector that produces a high pull-out force by simple means.

That object is achieved by the features defined in the independent claim.

DISCLOSURE OF THE INVENTION

The plug-in connector according to the invention comprises a base element with at least one side element. Further, at least one mounting element is provided for mounting the plug-in connector on a housing, for example, and/or for mounting a corresponding plug-in connector, for example. The side element comprises at least one locating element which fixes the mounting element in its position in the mounted condition of the plug-in connector.

Using simple means, the plug-in connector according to the invention provides high pull-out force relative to an element that is mechanically connected with the mounting element either directly or indirectly. This considerably increases the security from being torn off for example for a corresponding plug-in connector that is mechanically connected with the mounting element.

The locating element can be worked into the side element at no particular expense, which leads to cost advantages especially in series production. There will be no additional cost of materials for the locating element.

Another considerable advantage resides in the fact that the pull-out force is increased without any additional space being required. As a result, the previous style of the plug-in connector can remain unchanged. This is a particular advantage especially in cases where a standardized plug-in connector, such as a trapezoid plug-in connector or a D-Sub plug-in connector according to DIN 41652 or IEC 807-3, respectively, is to be realized.

A further advantage of the plug-in connector according to the invention results from the simple mounting procedure of the plug-in connector. This provides additional cost advantages, especially in series production.

When the side element, the locating element and the mounting element are electrically conductive, and when a screening element is provided that screens at least the forward part of the base element, then the plug-in connector according to the invention has a high screening function. Due to the comparatively large electrically conductive surfaces not only a low-resistance but also, and especially, a low-inductance connection for an electric circuit mass, and correspondingly efficient screening in the high-frequency range, is achieved.

Advantageous further developments and embodiments of the invention will become apparent from dependent claims.

One advantageous embodiment provides that the locating element is implemented as a clip which in the mounted condition of the locating element embraces the mounting element at least in part. Preferably, the clip has two arms. Advantageously, at least one groove, extending over part of the mounting element, is provided, in the mounting element for being engaged by the locating element or the arms of the clip in the mounted condition. When a tension force is exerted on the mounting element, which latter preferably is implemented as a bolt, a high axial contact pressure results that improves the electric contact characteristics by reducing the inductance of the contact.

As has been stated before, the screening element provided preferably is one that screens at least the front area of the plug-in connector where a matching plug-in connector is mounted. Further, the at least one mounting element is intended to fix the screening element in its position.

According to one embodiment, the screening element comprises at least one opening for the mounting element, for mechanically locating the mounting element in the mounted condition of the plug-in connector. Preferably, the mounting element is electrically conductive so as to provide the low-resistance or low-inductance connection between the screening element and the electric circuit mass that has been described above.

According to one embodiment, the side element comprises at least one contact spring that is in electric contact with the screening element in the mounted condition. The contact spring establishes an additional electric contact between the screening element and the preferably electrically conductive side element, thereby reducing the electric contact resistance still further.

An especially advantageous embodiment, intended to increase the pull-out force, provides that the side element comprises at least two locating elements which are provided in staggered arrangement and which engage correspondingly staggered grooves in the mounting element. The possibility to fix the mounting elements using at least two locating elements further counteracts any distortion of the mounting element relative to the plug-in direction.

One embodiment of the invention provides that the mounting element is equipped with a thread on its forward end. The thread is intended to accept a screw for fixing a corresponding plug-in connector by screwing, in an effort to secure the plug-in connector in its position.

Another embodiment provides that the mounting element comprises a polyhedral element, for example a square element, that engages a corresponding recess for the polyhedral element in the base element, in the mounted condition of the mounting element. This secures the mounting element against unwanted rotation, which is found to be especially convenient when the mounting element is provided with a thread on its forward end for screwing on further components.

According to one further development, the side element comprises a solder terminal for connection with a circuit board by soldering. The solder terminal preferably is implemented as an SMD solder terminal so that low-cost soldering of the plug-in connector to a circuit board can be realized while keeping dimensions small.

Other advantageous further developments and configurations of the plug-in connector according to the invention, having at least one side element, are apparent from the description that follows. One embodiment of the plug-in connector according to the invention is illustrated in the drawing in which.

Figure 1:
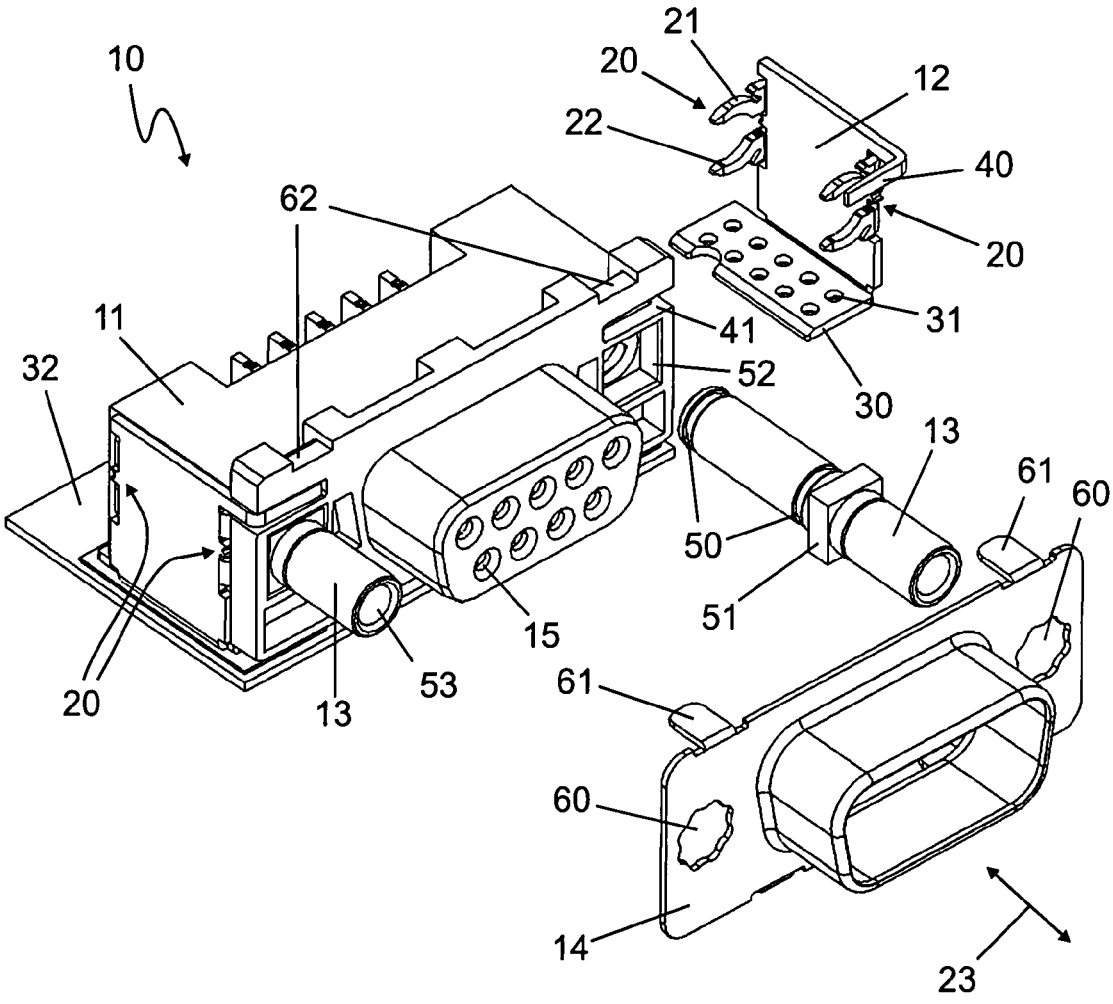
FIG. 1 shows an explosion view of a plug-in connector according to the invention comprising a base element, side elements, mounting elements and a screening element.

FIG. 1 shows an explosion view of a plug-in connector 10 according to the invention, comprising a base element 11 made from an electrically insulating material, two side elements 12, two mounting elements 13, a screening element 14 made from an electrically conductive material, as well as electric plug-in contacts 15.

It is assumed for purposes of the illustrated embodiment that the plug-in connector 10 is implemented as a trapezoid plug-in connector, also known as D-Sub plug-in connector. That type of plug is specified in more detail in DIN 41652 and IEC 807-3, respectively. Such a plug-in connector 10 usually is employed for making plug-in connections in the context of standardized interfaces, especially computer interfaces.

The side element 12 comprises at least one locating element 20 which may be described as a clip, for example. In the illustrated embodiment, the locating element, being implemented as a clip, is composed of two clip arms 21, 22. An especially simple configuration is obtained when the locating element 20, or the clip arms 21, 22, respectively, are worked from the side element 12 by punching and bending.

In the illustrated embodiment, two locating elements 20 are provided on one side element 12 in staggered arrangement, relative to the plug-in connector 23. The plug-in direction 23 likewise corresponds in this case to the longitudinal direction of the mounting element 13.

The side element 12 is provided, if necessary, with a solder terminal preferably implemented as SMD solder terminal. According to one embodiment, the solder terminal 30 comprises at least one recess 31 that can be entered by the soldering flux. The solder terminal 30 is provided especially in cases where the plug-in connector 10 according to the invention is intended for being soldered to a board 32.

Preferably, the side element 12 comprises at least one contact spring 40 that is positioned in a contact spring recess 41 in the base element 11 in the mounted condition of the side element 12.

Advantageously, the side element 12, including the contact spring 40, is electrically conductive and the contact spring 40 is in electric contact with the screening element 14 in the mounted condition. It is then possible with advantage to establish connection with an electric circuit mass, not shown in detail, via the solder terminal 30 of the side element 12. The flat configuration of the side element 12, the contact spring 40 and the screening element 14 leads to a low-inductance mass connection that guarantees a screening effect even at high signal frequencies.

The mounting element 13 preferably is implemented in the form of a bolt extending in the plug-in direction 23. The bolt is a comparatively simple lathe work and can thus be produced at low cost. The mounting element 13 comprises at least one groove 50, extending over at least part of its periphery, that is engaged by the locating element 20 in the mounted condition. During assembly, the clip arms 21, 22 are latched in the groove 50 or are clicked into the groove 50. The clip arms 21, 22 therefore preferably have a configuration such that the clip arm 21, 22 corresponds in function to a circlip of a shaft, at least approximately.

In the mounted condition, the at least one locating element 20 secures the mounting element 13 at least against displacement in the plug-in direction 23. As in the mounted condition of the plug-in connector 10 the mounting element 13 is friction-locked on the base element 10 and, accordingly, on the plug-in contacts 15 arranged in the latter, the at least one locating element 20 contributes considerably toward increasing the pull-out force of the plug-in connector 10.

Preferably, the locating element 20 and the mounting element 13 are made from an electrically conductive material. An increased screening effect is achieved especially when the electric contact between the mounting element 13 and the screening element 14 is realized in the mounted condition by a mounting element passage 60 in the screening element 14, for example. When a tensile load acts on the mounting element 13, the electric contact resistance is lowered in the holding zones of the locating element 20 in the groove 50 with the result that the electric resistance drops and the screening effect increases correspondingly.

The mounting element 13 preferably comprises a polyhedral element 51, preferably a square element, which in the mounted condition engages a recess 52 for the polyhedral element in the base element 11. The polyhedral element 51 provides a simple means of securing the mounting element 13 against rotation relative to the base element 11.

Such means of securing the mounting element 13 against rotation is of advantage, especially, when the mounting element 13 is provided with a thread 53, preferably an internal thread, at least at its forward end. The thread 53 is intended to receive a screw, arranged on a corresponding plug-in connector, not shown in detail, that is to be screw-connected with the plug-in connector 10 according to the invention for securing the plug-in connector in its position, or on another component that is to be connected with the plug-in connector 10. In that case especially the at least one locating element 20 of the side element 12 considerably increases the pull-out force of the plug-in connector 10 according to the invention still further.

In addition, the mounting element 13 may be provided for attaching the plug-in connector 10 according to the invention to a housing not shown in detail, for example a computer housing. Such connection preferably is realized as a screwed connection.

The screening element 14 preferably comprises at least one lug 61 which in the mounted condition engages a recess 62 provided for the lug in the base element 11. During assembly of the plug-in connector 10 according to the invention, the lug 61 is bent over in the recess 62 for the lug, with the effect that the screening element 14 is friction-locked on the base element 11.

Figure 2:
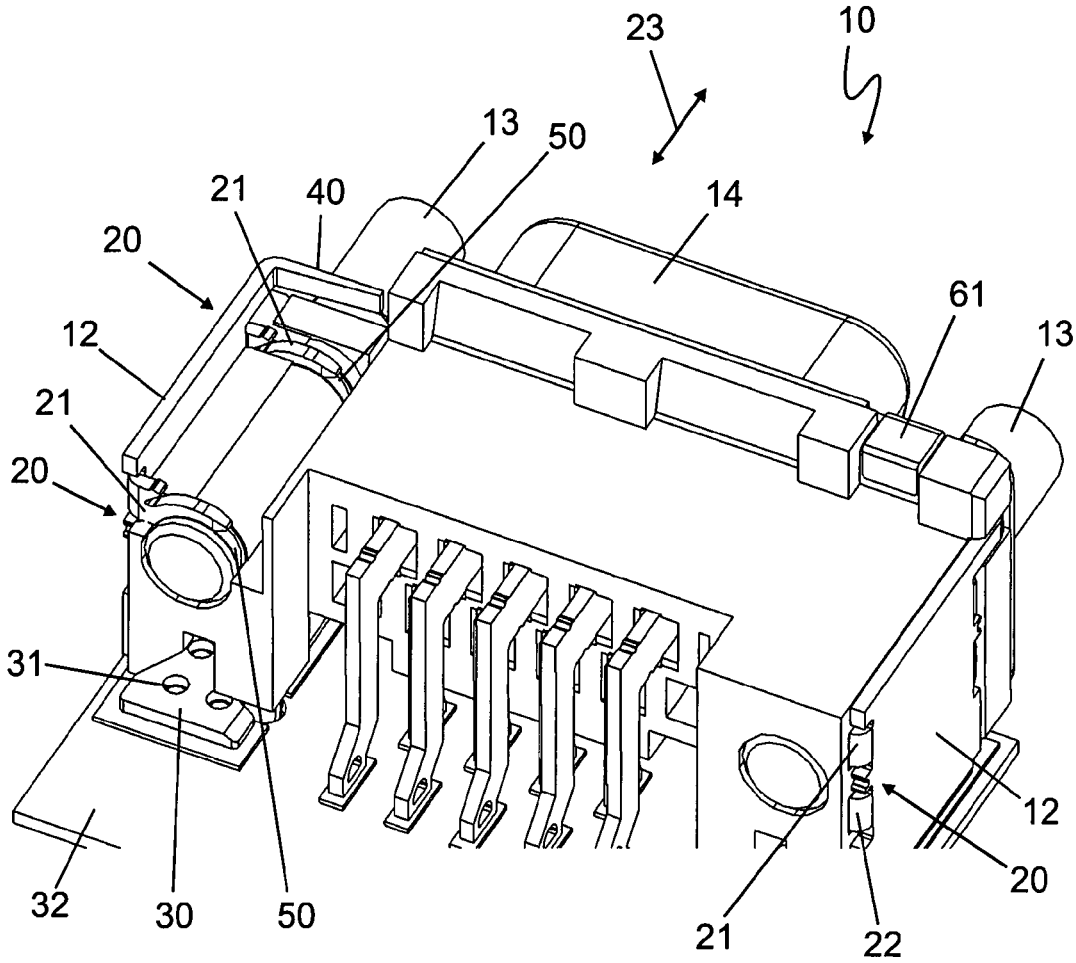
FIG. 2 shows a perspective view, sectioned in part, of a rear side of a plug-in connector according to the invention.
Figure 3:
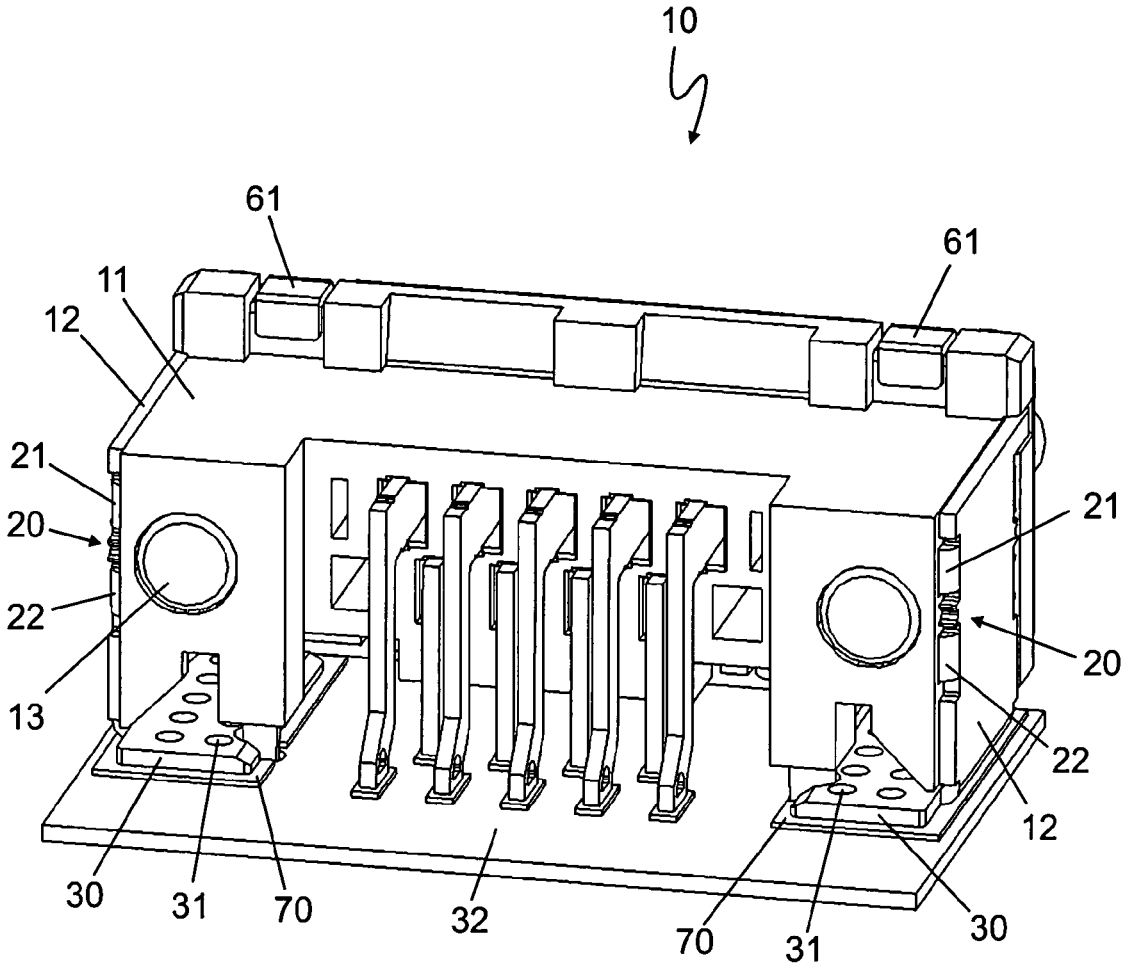
FIG. 3 shows a perspective view of a rear side of a plug-in connector according to the invention.
Figure 4:
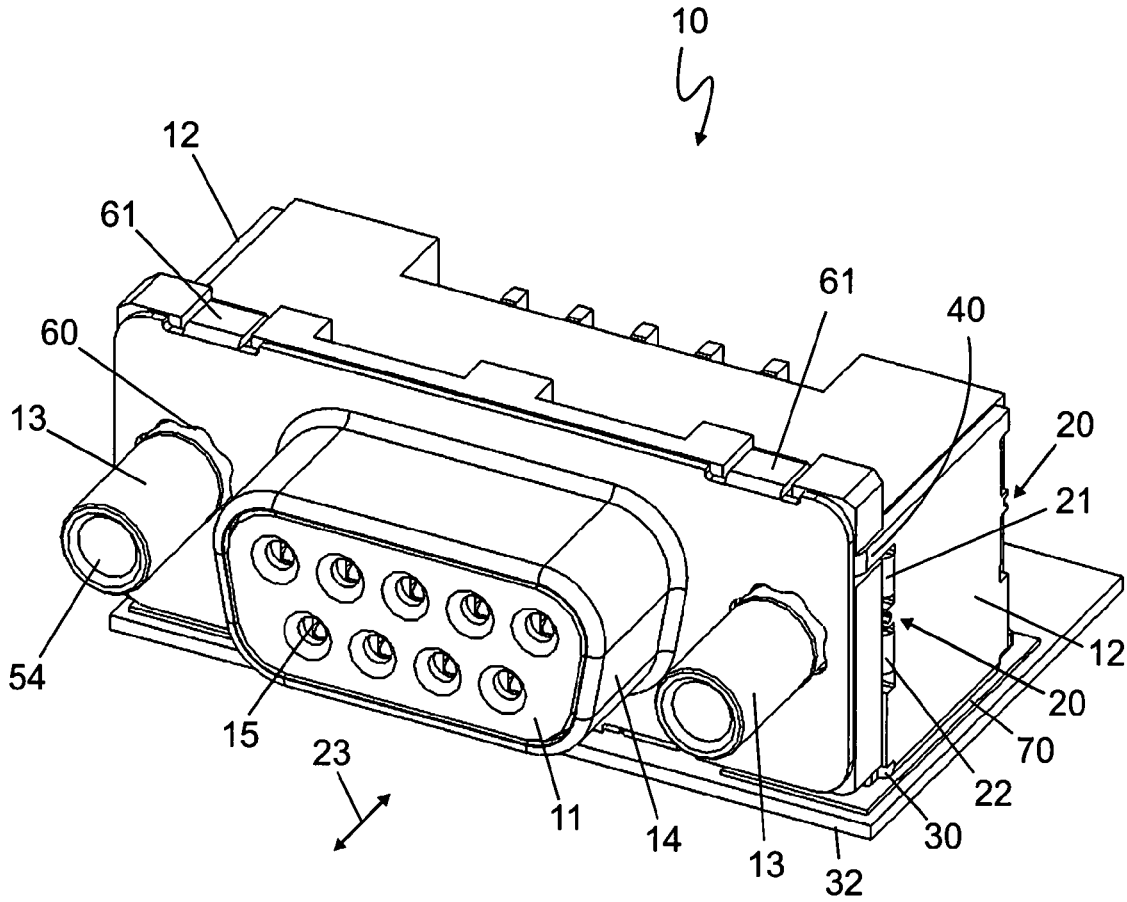
FIG. 4 sows a perspective view of a front of a plug-in connector according to the invention.

FIGS. 2 to 4 show different perspective views of the plug-in connector 10 according to the invention in the mounted condition. Those parts in FIGS. 2 to 4 that correspond to the parts illustrated in FIG. 1 are therefore identified by the same reference numerals.

FIG. 2 shows a perspective rear view of the plug-in connector 10 according to the invention, sectioned in part in the area of a mounting element 13. Consequently, there can be seen in FIG. 2 a mounting element 13 with the locating element 20 clicked into the at least one groove 50.

The illustrated embodiment is assumed to have two locating elements 20 provided in staggered arrangement in the plug-in direction 23 and/or in the longitudinal direction of the mounting element 13. Locating the mounting element 13 by multiple means has the effect to counteract any distortion of the mounting element 13 relative to the plug-in direction 23, thereby additionally improving the stability of the plug-in connector 10 according to the invention.

FIG. 2 further provides a view of the contact spring 40, if provided, that contacts the screening element 14 preferably installed.

FIG. 3 shows a perspective rear view of the plug-in connector 10 according to the invention. Especially, FIG. 3 shows the solder terminal 30 provided on at least one side element 12, which is soldered to a soldering area 70 on the board 32.

FIG. 4 finally shows a perspective front view of the plug-in connector 10 according to the invention, in mounted condition in the configuration of a plug-in board connector arranged on the board 32.

The invention claimed is:

1. A plug-in connector having a base element and at least one side element, wherein at least one mounting element is provided for mounting the plug-in connector and/or for mounting a matching plug-in connector and wherein the at least one side element comprises at least two locating elements spaced from each other in a plug-in direction, which fix the mounting element in a position in a mounted condition of the at least two locating elements, wherein each locating element comprises two clip arms; and wherein the each locating element is electrically conductive and establishes electric contact with the mounting element in the mounted condition.

2. The plug-in connector as defined in claim 1, wherein each clip arm in the mounted condition of the locating element embraces the mounting element at least in part.

3. The plug-in connector as defined in claim 1, wherein at least one groove, extending over part of the mounting element, is provided in the mounting element for being engaged by at least one locating element in the mounted condition.

4. The plug-in connector as defined in claim 1, wherein the mounting element is implemented in the form of a bolt.

5. The plug-in connector as defined in claim 1, wherein a screening element is provided that encloses at least a forward region of the base element.

6. The plug-in connector as defined in claim 5, wherein the screening element comprises at least one opening for the mounting element.

7. The plug-in connector as defined in claim 5, wherein the mounting element is electrically conductive and establishes electric contact with the screening element.

8. The plug-in connector as defined in claim 5, wherein the at least one side element is electrically conductive and comprises at least one contact spring that establishes electric contact with the screening element in the mounted condition.

9. The plug-in connector as defined in claim 1, wherein the mounting element is equipped with a thread on its forward end.

10. The plug-in connector as defined in claim 1, wherein the mounting element comprises a polyhedral element that engages a corresponding recess for the polyhedral element in the base element, in the mounted condition of the mounting element.

11. The plug-in connector as defined in claim 1, wherein the at least one side element comprises a solder terminal for being soldered to a circuit board.

12. The plug-in connector as defined in claim 11, wherein the solder terminal is implemented as an Surface Mounted Device solder terminal.

13. The plug-in connector as defined in claim 1, wherein the plug-in connector is implemented as trapezoid plug-in connector/D-Sub plug-in connector.

* * * * *